US008985596B2

(12) United States Patent
Wu

(10) Patent No.: US 8,985,596 B2
(45) Date of Patent: Mar. 24, 2015

(54) STEPPING CYCLE FOR ACCELERATED WALKING

(71) Applicant: Katherine Wang Wu, Vienna, VA (US)

(72) Inventor: Katherine Wang Wu, Vienna, VA (US)

(73) Assignee: Katherine Wu, Vienna, VA (US)

( * ) Notice: Subject to any disclaimer, the term of this patent is extended or adjusted under 35 U.S.C. 154(b) by 0 days.

(21) Appl. No.: 13/961,747

(22) Filed: Aug. 7, 2013

(65) Prior Publication Data

US 2015/0042054 A1 Feb. 12, 2015

Related U.S. Application Data

(60) Provisional application No. 61/680,701, filed on Aug. 8, 2012.

(51) Int. Cl.
*A63C 17/08* (2006.01)
*A63C 17/12* (2006.01)

(52) U.S. Cl.
CPC ..... *A63C 17/12* (2013.01)
USPC ..... 280/11.24; 280/11.14

(58) Field of Classification Search
USPC ..... 280/11.15–11.18, 11.24
See application file for complete search history.

(56) References Cited

U.S. PATENT DOCUMENTS 92,936 A * 7/1869 Brownlee ..... 280/11.24
2010/0109266 A1* 5/2010 Jenkins ..... 280/11.204

* cited by examiner

*Primary Examiner* — Jeffrey J Restifo
*Assistant Examiner* — Erez Gurari
(74) *Attorney, Agent, or Firm* — Xiongwu Wu

(57) ABSTRACT

The present invention relates to a transportation device comprising one riding wheel, a U-shaped frame, and a stepping assembly. The riding wheel is mounted between the two ends of the U-shaped frame and the stepping assembly is mounted on the axle of the riding wheel. The stepping assembly contains a foot pedal and one or two supporting legs with an optional stepping wheel beneath the foot pedal. This device can conveniently convert between a riding mode and a walking mode to allow rider skate, walk, and stand in various ground surfaces.

10 Claims, 5 Drawing Sheets

STEPPING CYCLE FOR ACCELERATED WALKING

CROSS-REFERENCE TO RELATED APPLICATIONS

Provisional patent 61/680,701, Nezha cycle

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention describes a recreational and sporting device. More particularly, the present invention is in the technical field of a wheeled skate for the use on roads, sidewalks, parks, stages, and the like.

Various designs of roller skates have been developed over years. Most of roller skates have a plurality of small diameter wheels beneath the sole of the skater's foot. The small diameter of the wheels have difficulties in rugged surfaces and are not suitable for high speed movement.

Skates with larger diameter wheels have been invented over a century. For example, U.S. Pat. No. 92,936 describes a pedicycle that suspends the weight of the rider or load on the top of the wheel.

U.S. Pat. No. 256,765 describes a pedicycle with a wheel attached on the outside. The foot boards with have curved front platforms that provide support to the feet and allows for forward moving action when struck against ground.

U.S. Pat. No. 573,096 describes a skating cycle with a large wheel mounted in a frame with a foot plate, leg-clasp and a handle-bar. By mounting a cycle on each foot, one walks by alternatively advancing and withdraw or swing back and forth one's feet.

U.S. Pat. No. 889,580 describes a roller skate with a wheel mounted on vertical metal strips adapted for foot.

U.S. Pat. No. 1,023,882 describes a monocycle skate with a large wheel and a frame to be attached to the leg and a sole plate to secure the foot. It has a brake block to engage the rim of the wheel when the heel is lowered.

U.S. Pat. No. 2,675,243 describes a mono-wheel roller skate using spring to keep the wheel on the ground to improve the smoothness of riding.

U.S. Pat. No. 2,980,436 describes a single wheel skate that allows the skating wheel to be adjusted between operational and nonoperational positions through permanent magnets.

U.S. Pat. No. 4,363,493 describes a uniwheel skate which has a rim arranged to rotate about a frame. A foot support is pivotally carried by the frame and receives the rider's foot for transmission of the rider's body load to and through the frame to the wheel.

U.S. Pat. No. 7,661,682 B2 describes a sporting device with a skating wheel mounted on each foot. It uses a hand control to brake its movement.

U.S. Pat. No. 7,758,054 describes a roller skate that has outer, larger rollers on the side with smaller inline rollers arranged below the boot.

US patent 2010/0109266 describes a sporting device which contains a wheel, a foot support mounted on the wheel, and a biased member attached between the foot support and an upper end of the leg support.

Many patents including above mentioned explored various ways to utilize large side mount wheels for skating. However, several problems make side mount wheels difficult to use. First, the center of mass of the rider is not coincident with the supporting point when wheel is side mounted, which requires a design to maintain balance when standing and in motion. Second, the large diameter of the skating wheel makes rider difficult to control, requiring a mechanism to relay rider's force to surface. Third, to access all road conditions, it requires a convenient mechanism to convert between skating and walking mode.

The object of the invention is the provision of a transportation device that allows skating on flat surface and walking on none flat surface.

Another object of this invention is to achieve a balanced position when riding, walking, and standing.

Another object of this invention is to provide rider reliable and convenient control of the movement.

SUMMARY OF THE INVENTION

The present invention is a stepping cycle comprising a riding wheel, a U-shaped frame, and a stepping assembly. In a preferred embodiment, the riding wheel is mounted between the two ends of the U-shaped frame. A leg attachment is mounted on the U-frame. The stepping assembly is mounted on the axle of the riding wheel and can rotate around the axle to change its angle in related to the U-shaped frame. The stepping assembly contains one or two supporting legs and a foot pedal. One end of the supporting legs is mounted on the axle of the wheel. There are stepping shoes to provide supporting points for braking and propelling. Foot pedals are mounted on the supporting legs to support rider's feet. On the foot pedal there are foot restraints to attach the device to a foot. In alternative embodiments, a shoe is permanently mounted on the foot pedal. In another alternative embodiment, a supporting wheel is mounted beneath the foot pedal to provide extra stability for riding, walking, and standing.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Referring now to the invention in more detail, in FIG. 1 to FIG. 15, there is shown a device, called stepping cycle, which is used as a vehicle for a rider for the purpose of transportation or entertainment.

Figure 1:
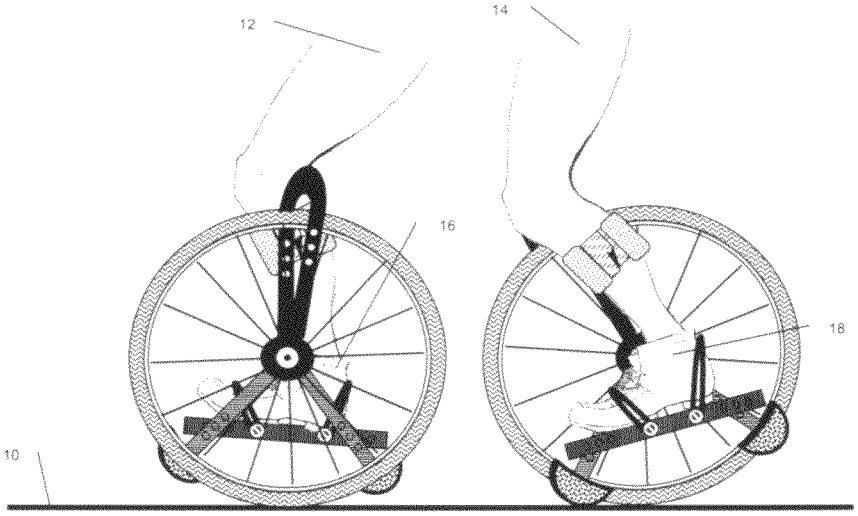
FIG. 1 is a side view of the embodiment of the present invention attached to the right foot and to the left foot in a riding mode.

FIG. 1 shows the invention attached to each foot of a skater in a riding mode. On a hard surface 10, such as road, street, play ground, or stage, a rider wears one device on the left leg 12 and one device on the right leg 14. The left foot 16 and right foot 18 are restrained to each device. In FIG. 1, the right leg is in a propelling position and the left leg is in a gliding position. After the right foot propelling, the rider glides on the left device and, during the meantime, lifts the right device and carries it forward and steps on ground for next gliding motion. Then, the left foot does the propelling and so on.

Figure 2:
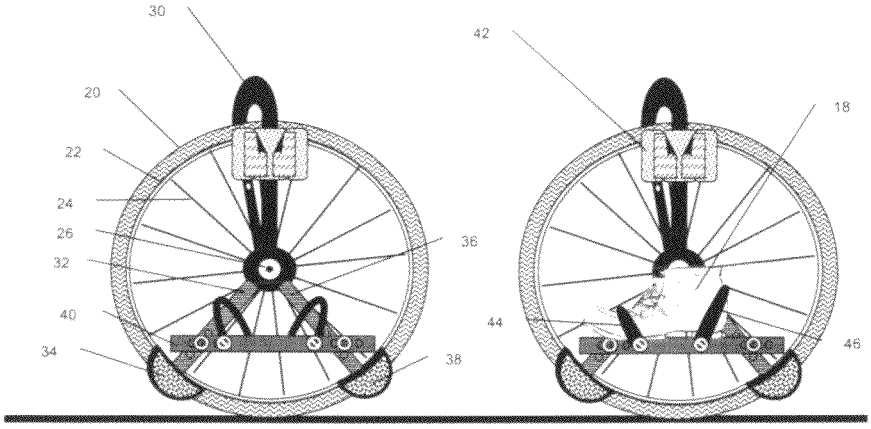
FIG. 2 is a side view of the embodiment of the present invention, with and without the right foot, viewed from the stepping side.

FIG. 2 is a side view of the embodiment of the present invention, viewed from the stepping side on which the stepping assembly mounts. The embodiment has a riding wheel, which contains tire 20, rim 22, rods 24, and axle 26. The riding wheel's axle 26 is mounted between the two ends of a U-shaped frame 30. On the wheel axle 26 a stepping assembly is mounted, which contains two supporting legs 32 and 36, and a foot pedal 40. The supporting leg 32 has a stepping shoe 34 and the supporting leg 36 has a stepping shoe 38. The U-shaped frame 30 is attached to rider's leg with a leg coupling 42. On the foot pedal 40, there are foot restraints 44 and 46, which hold skater's foot 18 on the foot pedal 40.

Figure 3:
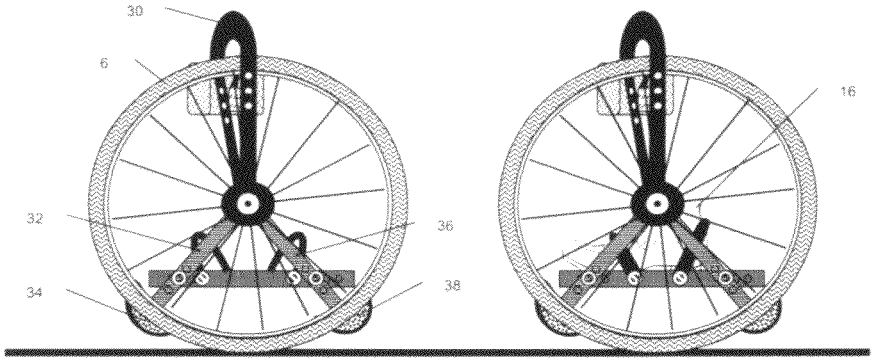
FIG. 3 is a side view of the embodiment of the present invention, with and without attached to the left foot, viewed from the non-stepping side.

FIG. 3 is a side view of the embodiment of the present invention, viewed from the non-stepping side and attached to the left foot 16.

Figure 4:
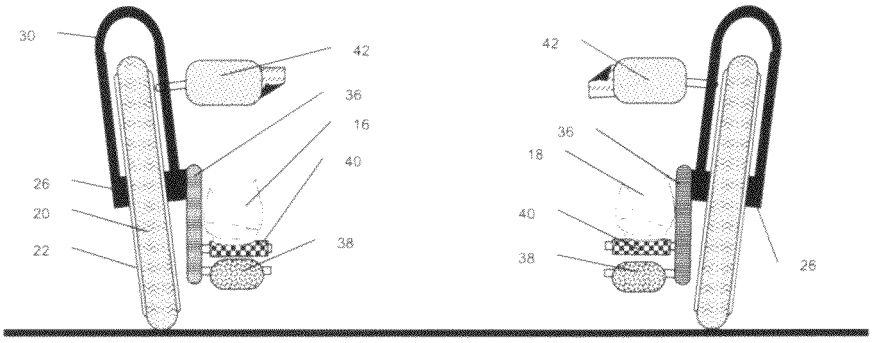
FIG. 4 is a rear view of the embodiment of the present invention attached to the right foot and to the left foot in a riding position.

FIG. 4 is a rear view of the embodiment attached to the right foot 18 and the left foot 16 in a riding mode. The wheels tilt outward to balance the rider's center of mass. The leg coupling 42 keeps a distance between the U-shaped frame 30 and the leg to force the riding wheel tilt outward.

Figure 5:
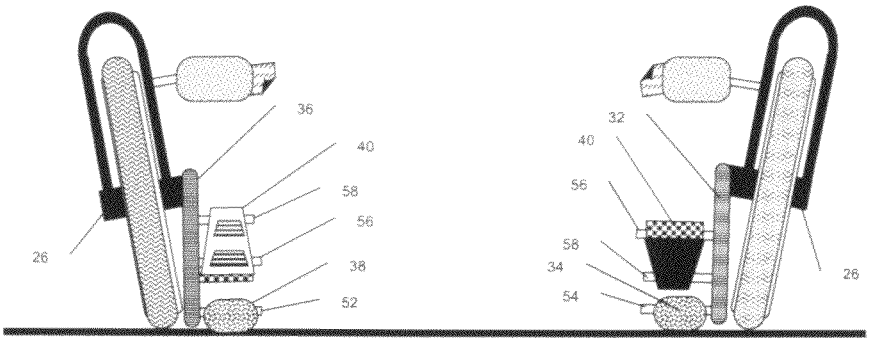
FIG. 5 is a rear view of the embodiment of the present invention in a braking position for the left foot and in a propelling position for the right foot.

FIG. 5 shows the rear views of the embodiment for the left foot in a braking position and the embodiment for the right foot in a propelling position. The stepping assembly tilts forward when the rider shifts the center of mass to the heel, which causes the back stepping shoe 38 to press against ground surface and brake the forward motion. The stepping assembly tilts backward when the rider shifts the center of mass to the toe, which causes the front stepping shoe 34 to press against ground surface and propel the rider move forward. The rider can stand in either the propelling position or the braking position. The front stepping shoe 34 is mounted on the front supporting leg 32 with a bolt 54 and the back stepping shoe 38 is mounted on the back supporting leg 36 with a bolt 52. The foot pedal 40 is mounted on the front supporting leg 32 with a bolt 58 and on the back supporting leg 36 with a bolt 56.

Figure 6:
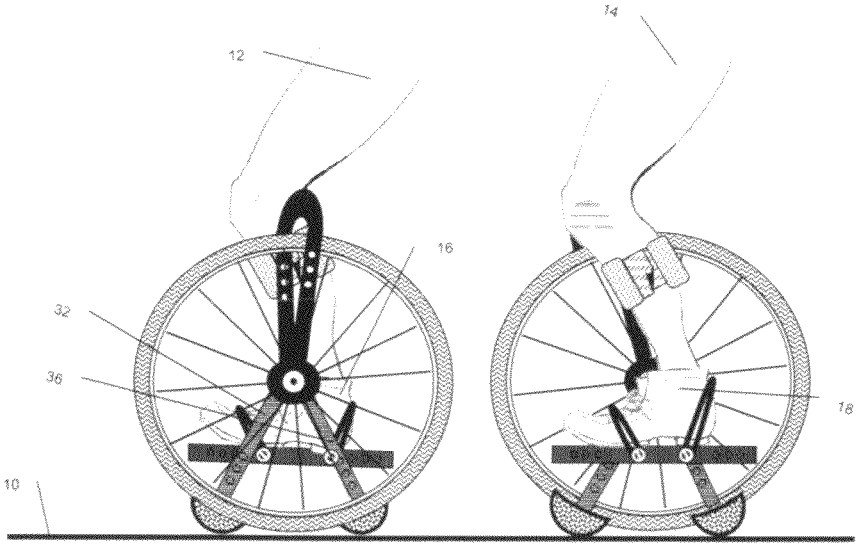
FIG. 6 is a side view of the embodiment of the present invention in a walking mode attached to the right foot and to the left foot. The angle between the two supporting legs is reduced to lift the wheel from ground.

FIG. 6 is a side view of the embodiment in a walking mode where the two supporting legs 32 and 36 reduce their angle to lift the riding wheel from ground.

Figure 7:
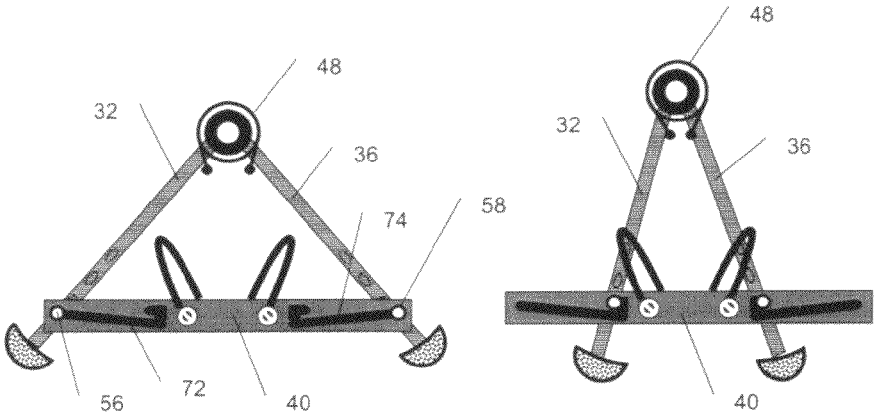
FIG. 7 shows the stepping assembly in the riding mode when the two supporting legs form a wide angle and in the walking mode when the two supporting legs reduce their angle.

FIG. 7 shows a foot pedal design that allows convenient converting of the stepping assembly from a riding mode to a walking mode. On the foot pedal 40, there are adjustable mounting slots 72 and 74 for the mounting bolts 56 and 58. The angle between the supporting legs 32 and 36 can be changed by tapping the front leg 32 forward and/or tapping the back leg 36 backward to allow them take specific positions. A tension spring 48 can be used to produce an angular tension between the supporting legs.

Figure 8:
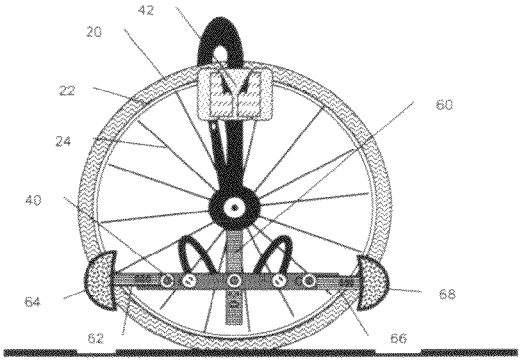
FIG. 8 is a side view of the embodiment of the present invention with one supporting leg in its stepping assembly. The foot pedal is mounted on the supporting leg and can rotate around the mounting axle. The foot pedal has two shoes at its two ends. In a riding mode, the two shoes take a flat position as shown.

FIG. 8 is a side view of an alternative embodiment with one center supporting leg 60. The foot pedal 40 is mounted on the center leg 60. The foot pedal 40 can be mounted on the center leg 60 at different heights to allow different stepping angular ranges. The front toe 62 and the back toe 66 are mounted on the foot pedal 40 with an adjustable angle for conversion between riding (FIG. 8) and walking (FIG. 9) modes. In the riding mode shown in FIG. 8, the stepping toes take a flat position. Rider can propel by pressing down the front of the foot pedal and can brake by pressing down the rear of the foot pedal.

Figure 9:
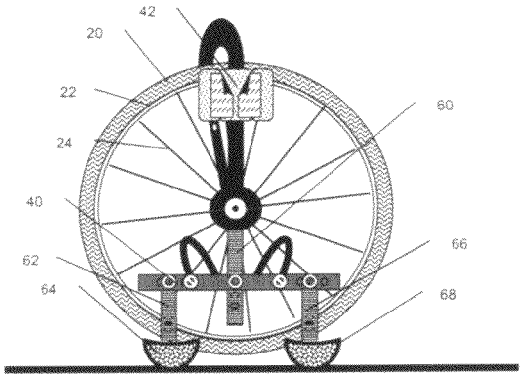
FIG. 9 is a side view of the embodiment of the present invention with one supporting leg in its stepping assembly. The foot pedal is mounted on the supporting leg and can rotate around the mounting axle. The foot pedal has two shoes at its two ends. In a walking mode, the two shoes take a vertical position to lift the wheel from ground as shown.

FIG. 9 shows a side view of an alternative embodiment with one center leg 60 in the walking mode where the stepping toes 62 and 66 take a vertical position to lift the wheel from ground.

Figure 10:
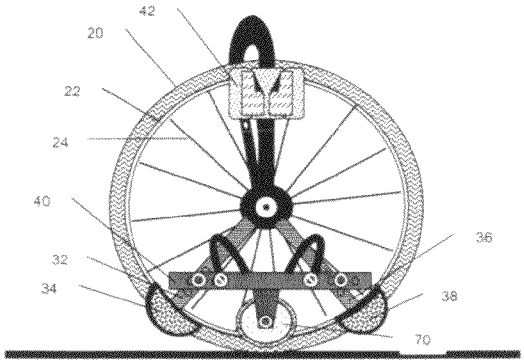
FIG. 10 is a side view of the embodiment of the present invention with two supporting legs and a stepping wheel beneath the foot pedal.

FIG. 10 is a side view of an alternative embodiment with a stepping wheel 70 mounted beneath the foot pedal 40 in the stepping assembly with two supporting legs.

Figure 11:
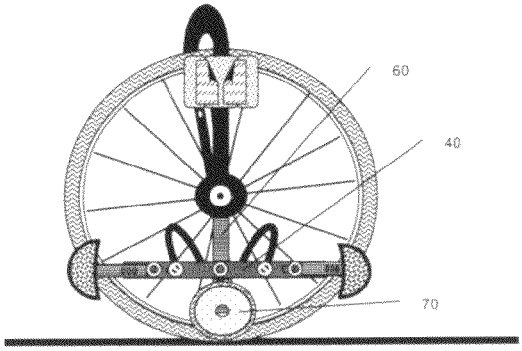
FIG. 11 is a side view of the embodiment of the present invention with one supporting leg and a stepping wheel beneath the foot pedal.

FIG. 11 is a side view of an alternative embodiment with one center leg 60 and a stepping wheel 70 beneath the foot pedal 40.

Figure 12:
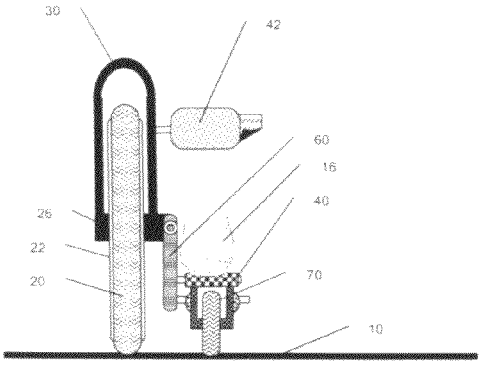
FIG. 12 is a rear view of the embodiment of the present invention with a stepping wheel beneath the foot pedal at its upright position.

FIG. 12 shows the invention with a stepping wheel 70 in a walking mode or straight riding mode. When walking or riding in a straight-up position, the stepping wheel supports the skater and both the stepping wheel and the riding wheel roll on the ground surface 10.

Figure 13:
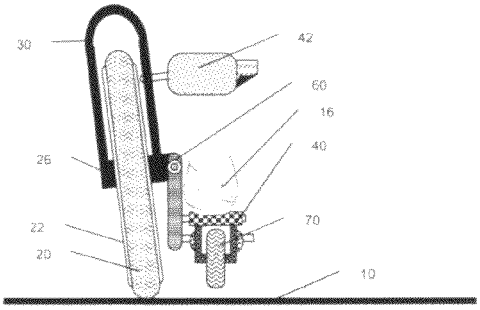
FIG. 13 is a rear view of the embodiment of the present invention with a stepping wheel beneath the foot pedal at its tilt position.

FIG. 13 shows the invention with a stepping wheel 70 in a tilted riding position. When riding fast, a rider can tilt to outer side and the stepping wheel is lifted from the ground surface 10 to allow the center of mass falls on the riding wheel.

Figure 14:
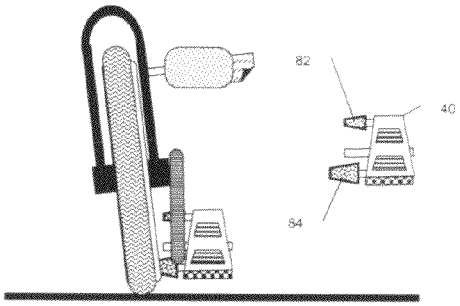
FIG. 14 is a rear view of the embodiment of the present invention that uses rim brake fingers for braking and propelling. The rim brake fingers are mounted on the foot pedal as shown.

FIG. 14 shows an alternative embodiment that uses rim brake fingers 82 and 84 to brake the riding wheel. The rim brake fingers are mounted to the side of the foot pedal toward the riding wheel.

When the foot pedal is pressed forward or backward, the rim brake finger will press against the rim of the riding wheel to brake its movement.

Figure 15:
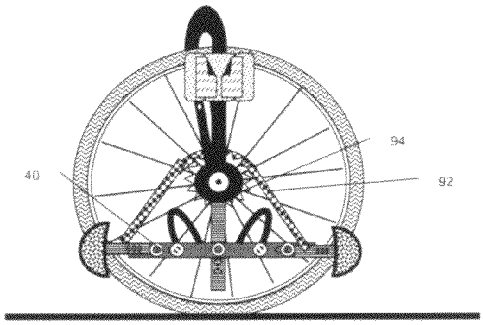
FIG. 15 is a side view of the embodiment of the present invention that uses a chain connecting the two ends of the foot pedal to drive the riding wheel through a sprocket at the axle of the riding wheel.

FIG. 15 show an alternative embodiment that the movement of the riding wheel is powered by swing motion of the foot pedal 40 through a chain 92 connected to the foot pedal 40 and going through a sprocket 94 at the axle of the riding wheel.

In further detail, still referring to the invention of FIG. 1 to FIG. 15, the size of the riding wheel can vary for comfort and vary purposes, such as a diameter between 5 and 30 inches. The stepping arms should be long enough to make the stepping shoes reach out of the wheel.

The construction details of the invention as shown in FIG. 1 to FIG. 15 are that the U-shaped frame 30 may be made of aluminum alloy or any other sufficient rigid and strong material such as high-strength plastic, metal, and the like. The stepping assembly can be made of strong materials such as aluminum alloy or high-strength plastic, metal, and the like.

The advantages of the present invention include, without limitation, that it can be used in any road conditions for both walking and riding, including climbing. It allows a rider to stand comfortably and provides a natural walking way to propel forward and a natural way to brake. Its large riding wheel allows fast gliding when road condition is good. The U-shaped frame provides stable support for the riding wheel and allows firm control of the tilt angle of the riding wheel. The stepping assembly provides support for propelling force and braking force. It provides convenient way to adjust heights and angle ranges. It allows a rider's center of mass to align easily with the riding wheel to achieve a balanced riding and walking.

In broad embodiment, the present invention is a stepping cycle with a riding wheel for each foot.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A transportation device comprising:

(a). a U-shaped frame with a leg attachment;

(b). a riding wheel with its axle mounted between the two ends of said U-shaped frame;

(c). a stepping assembly attached to the axle of the riding wheel, wherein the stepping assembly has two supporting legs and a foot pedal; wherein each said supporting leg has a stepping shoe; and the supporting legs are longer than the radius of the riding wheel so that the stepping shoes reach beyond the riding wheel; the foot pedal is attached to the two supporting legs.

2. A transportation device according to claim 1, wherein the foot pedal has adjustable mounting slots to change the angle between supporting legs.

3. A transportation device according to claim 1, wherein a supporting wheel is mounted beneath the foot pedal.

4. A transportation device according to claim 1, wherein a footwear is permanently mounted on the foot pedal.

5. A transportation device comprising:

(a). a U-shaped frame with a leg attachment;

(b). a riding wheel with its axle mounted between the two ends of said U-shaped frame;

(c). a stepping assembly attached to the axle of the wheel, wherein the stepping assembly has one supporting legs and a foot pedal; there are two stepping shoes mounted in the front and back ends of the foot pedal; the foot pedal is attached to the supporting leg.

6. A transportation device according to claim 5, wherein the stepping shoes on the foot pedal can be adjusted to the vertical walking position.

7. A transportation device according to claim 5, wherein a supporting wheel is mounted beneath the foot pedal.

8. A transportation device according to claim 5, wherein a footwear is permanently mounted on the foot pedal.

9. A transportation device according to claim 5, wherein the rim brake fingers are mounted on the foot pedal.

10. A transportation device according to claim 5, wherein a chain connected to the foot pedal drives a sprocket at the axle of the riding wheel.

* * * * *